US005114442A

United States Patent [19]

Artz

[11] Patent Number: 5,114,442

[45] Date of Patent: May 19, 1992

[54] RAPPER CONTROL SYSTEM FOR ELECTROSTATIC PRECIPITATOR

[75] Inventor: Karl M. H. Artz, Madison, Ohio

[73] Assignee: Neundorfer, Inc., Willoughby, Ohio

[21] Appl. No.: 634,427

[22] Filed: Dec. 27, 1990

[51] Int. Cl.[5] ..... B03C 3/76

[52] U.S. Cl. ..... 55/112; 323/903

[58] Field of Search ..... 55/12, 13, 112, 114, 55/117, 120, 121, 110, 105, 139; 361/161; 323/903; 335/217

[56] References Cited

U.S. PATENT DOCUMENTS

| | | | |
|---|---|---|---|
| 3,030,753 | 4/1962 | Pennington | 55/112 |
| 3,360,902 | 1/1968 | Glaeser | 55/13 |
| 3,504,480 | 4/1970 | Copcutt et al. | 55/112 |
| 3,570,628 | 3/1971 | Rodgers | 55/112 X |
| 3,605,915 | 9/1971 | Gately et al. | 55/112 X |
| 4,285,024 | 8/1981 | Andrews | 361/160 |
| 4,456,898 | 6/1984 | Frischmann | 335/217 |
| 4,459,574 | 7/1984 | Tokuda | 335/217 |
| 4,559,064 | 12/1985 | Ahern | 55/145 |
| 4,693,732 | 9/1987 | Blackford et al. | 55/112 |
| 4,793,372 | 12/1988 | Gauthier et al. | 137/82 |
| 4,928,456 | 5/1990 | DelGatto et al. | 55/112 X |

*Primary Examiner*—Richard L. Chiesa
*Attorney, Agent, or Firm*—Michael Sand Co.

[57] ABSTRACT

An improved rapper control system for an electrostatic precipitator for adjusting the power supplied to electromagnetic impact rappers to compensate for known effects of temperature variations on the magnetic coil of the rapper. An ambient temperature sensor is located in the vicinity of the rapper and supplies information to a computational-control unit which regulates the voltage and current supplied to the rapper coil or the duration that the power is supplied to the rapper coil in relationship to temperature changes about the rapper coil, to compensate for such temperature changes. Feedback circuits which measure current in the rapper coil may be coupled with the control unit to maintain a constant current flow through the rapper coil. Also a sensor can measure the rapper kinetic energy output and when combined with the ambient temperature sensor, will enable the control unit to regulate the rapper power supply to provide relatively constant rapper energy output with changing operating temperatures of the rapper coil.

11 Claims, 3 Drawing Sheets

RAPPER CONTROL SYSTEM FOR ELECTROSTATIC PRECIPITATOR

BACKGROUND OF THE INVENTION

1. Technical Field

The invention relates to control systems for electromagnetic impact rappers for electrostatic precipitators and in particular to the regulation of the electrical power or energy delivered to the magnetic rappers so as to maintain consistent rapping energy output over a wide variation of ambient operating temperatures about the rappers.

2. Background Information

Electromagnetic impact rappers are widely used for cleaning the discharge wires and collecting plates of electrostatic precipitators which remove or recover particulate matter from moving gas streams in industries such as electrical power generation, steel making, cement plants, paper mills and the like. These rappers usually are installed within a weather resistant enclosure or are exposed to the outside ambient conditions. In both cases, rapper coil operating temperature is uncontrolled. Solar heating, combined with day to night ambient temperature changes, plus seasonal temperature changes, can easily cause a 40° to 50° centigrade change in rapper coil operating temperature with a resultant 16% to 20% change in coil resistance. Although the duty cycle of the rappers is low enough that the effects of self heating of the coil due to power dissipation within the coil is negligible, actual testing of usual electromagnetic impact rappers indicate that a 25% to 50% change in energy output over a 50° centigrade temperature excursion will occur. This relatively large variation in rapper output energy can cause deteriorated precipitator performance and precipitator structural damage.

Common electromagnetic rapper control systems and known methods energize the rapper coil with a preselected voltage applied for a preselected time. As the rapper coil resistance changes with changing operating temperatures, the current through the rapper coil also will change. This changes the strength of the magnetic field generated by the rapper coil, the velocity of the rapper slug as it is lifted against gravity or against the spring, and thus changes the potential energy stored in the rapper slug or slug and spring combination for subsequent transfer to the precipitator discharge electrode or collecting plate from which the collected matter is to be removed, and for certain types of rappers, it changes the magnetic force which directly causes the impact in combination with a return spring.

Various known prior art electromagnetic rappers and control systems are shown in the following patents.

U.S. Pat. No. 3,504,480 discloses a control system for a series of electrostatic precipitator rappers of the type with which the present control system may be utilized. Various feedback circuits are used in this system to regulate the firing angle of SCR devices to change the power supplied to the rappers. The feedback signals are from operating parameters such as the precipitator sparking rate, precipitator current and for changes in line voltage.

U.S. Pat. No. 4,285,024 shows another type of electrostatic precipitator rapper control system which includes means for sensing currents applied to each rapper coil during a controlled energy pulse. The resultant sensed current is integrated with respect to time over the period of the pulse of controlled energy and the results of the integration will indicate plunger displacement.

U.S. Pat. No. 4,693,732 discloses a rapper that can be adjusted to compensate for various factors including thermal expansion of the rapper mechanism. However, the adjustment is entirely manual and is accomplished by movement of lock nuts along a threaded shaft containing coil springs.

However, none of these known electrostatic precipitator control systems show the sensing of the ambient temperature about the rapper nor provide means for the subsequent compensation thereof, to effect the energy delivered by the rapper to the electrostatic precipitator collecting plates and discharge electrodes as in the present invention.

U.S. Pat. No. 4,456,898 discloses a type of ambient temperature magnetic control device completely unrelated to the electrostatic precipitator art.

U.S. Pat. No. 4,459,574 discloses another control circuit using electromagnetic force generation which provides temperature compensation of the coil current in a camera for controlling the shutter blades.

U.S. Pat. No. 4,793,372 discloses a solenoid valve in which the resistance of the coil changes with an increase or decrease in temperature to vary the amount of flux generated. Again, such a device is not used or associated in any manner with an electrostatic precipitator rapper as is the present invention.

Thus, the need exists for an improved rapper control and energization system that will maintain relatively constant rapper energy delivery to an electrostatic precipitator rapper over a wide variation in ambient operating temperatures about the rapper and electrostatic precipitator.

SUMMARY OF THE INVENTION

Objectives of the invention include providing an improved rapper control system for electromagnetic impact rappers which will provide reliable and consistent rapper kinetic energy output over a wide range of ambient operating temperatures as may be commonly encountered in the operation of the rappers.

Another objective of the invention is to provide such an improved rapper control system which will automatically adjust the rapper power supply to compensate for normally expected variances in rapper coil current caused by coil resistivity changes resulting from changes in the ambient temperature.

A still further objective of the invention is to provide such an improved rapper control system which uses one or more feedback arrangements to regulate the power delivered to the rapper coils to compensate for the effect of temperature changes on the rapper energy.

A still further objective is to provide such an improved rapper control system in which the magnitude of the power (voltage) supplied to the rapper coil can be varied and/or the duration during which the power is delivered to the rapper can be varied to compensate for ambient temperature variations and its effect on the rapper energy output.

Still a further objective of the invention is to provide such an improved rapper control system in which sensing devices which measure the current flowing through the rapper coil can be used to supply information to a computational unit and associated control unit to regulate the magnitude of rapper coil supply voltage in a manner to provide consistent current flow through the rapper coil independent of changes in rapper coil resistance due to changes in ambient temperature so as to provide constant rapper energy output over the normal operating temperature range of the rapper.

Still another objective is to provide such an improved rapper control system in which sensors can measure the rapper kinetic energy output which is combined with an ambient temperature sensor located in the vicinity of the rapper, to enable a computational unit to derive and store the effects of ambient temperature on rapper output, which then is used with an appropriate algorithm to regulate the rapper power supply to provide relatively constant rapper energy output with changing ambient operating temperatures.

These features and advantages are obtained by the improved rapper control system for an electrostatic precipitator, the general nature of which may be stated as including power supply means for supplying electrical power to a rapper device adapted to be mounted on an electrostatic precipitator, control means for adjusting the amount of electrical power supplied to the rapper device by the power supply means, temperature sensing means located generally adjacent to the rapper device for measuring ambient temperature adjacent to said rapper device, and first feedback means interconnecting the temperature sensing means and the control means for adjusting the output of the power supply means to compensate for changes in ambient temperature measured by the temperature sensing means.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Electrostatic precipitators have been used for many number of years to remove particulate material contained within moving gas streams to prevent the emission of the particulate materials out of the smoke stacks or other type of exhaust of the particular apparatus, such as the boiler of an electrical power plant, paper mill or the like. These electrostatic precipitators have various general arrangements such as shown in U.S. Pat. Nos. 3,030,753, 3,570,628, 3,605,915, and 4,559,064. In these precipitator constructions, a shock wave is imparted on a structural member of the precipitator which vibrates the member to dislodge the collected particulate material which then falls into a collection area for subsequent removal. Many of these electrostatic precipitators use electromagnetic impact rappers which consist of a coil wound of heavy gauge wire on a coil form. Electrical energy which is applied to the coil will cause a slug or piston to be raised within the coil form and upon release will fall and strike a part of the precipitator whereby the kinetic energy is applied to the collector device for transmitting the shock waves therethrough to remove the particulate materials.

Figure 1:
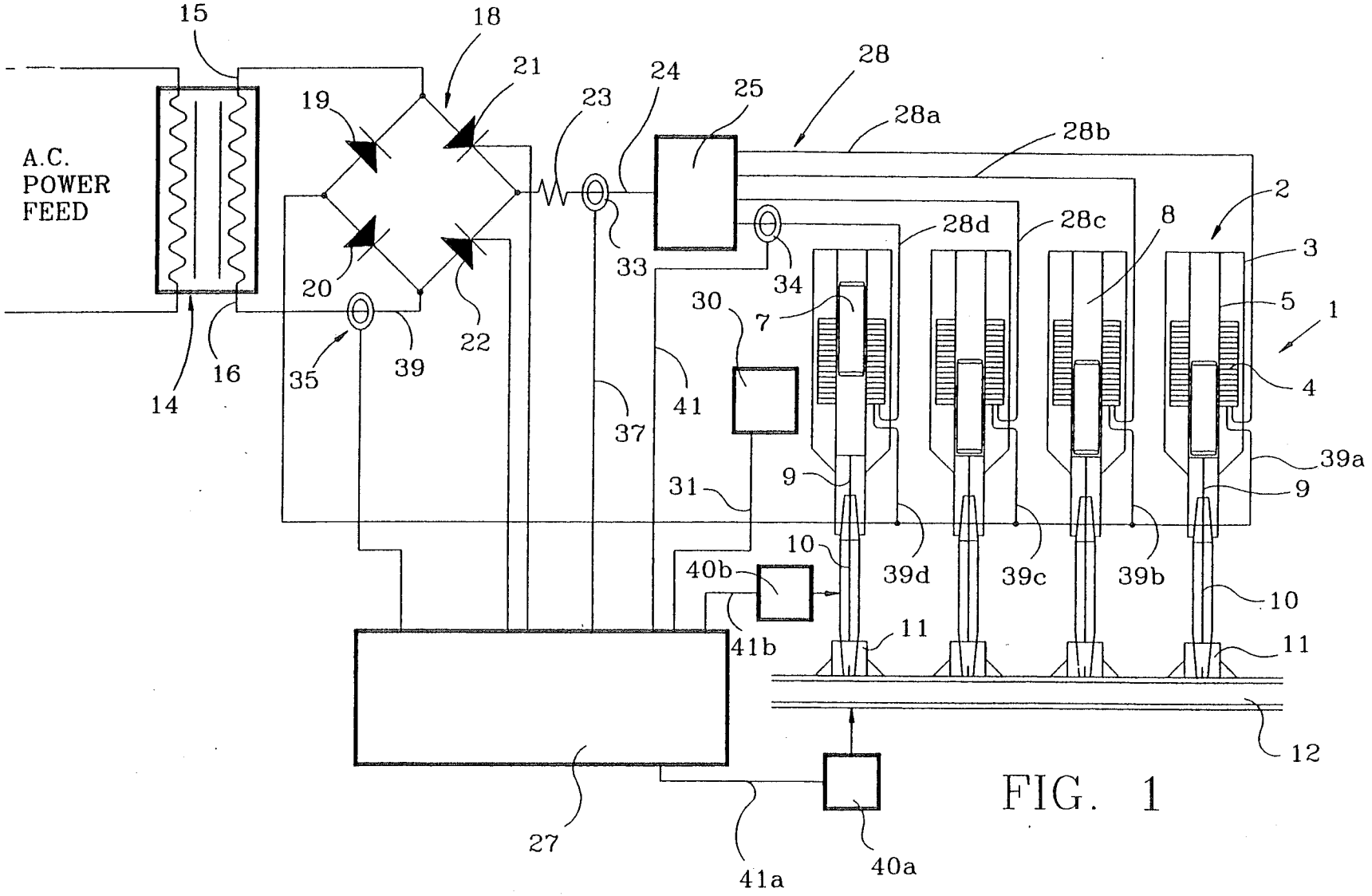
FIG. 1 is a schematic diagram of the improved rapper control system connected to one or more rappers using a full wave bridge rectifier circuit for regulating the rapper coil supply.

A typical electrostatic precipitator such as shown in U.S. Pat. No. 4,559,064 will have a rapper system mounted thereon as is indicated generally at 1, and shown in FIGS. 1, 2 and 3. Rapper system 1 consists of four individual electromagnetic rappers, each of which is generally indicated at 2. It is readily understood that the number of rappers can vary without affecting the concept of the invention. Each rapper 2 consists of an outer case 3 containing a coil of wire 4 wound onto a phenolic coil form 5 or other type of coil form. A slug or plunger 7 is slidably mounted within the hollow interior 8 of each coil form 5. When released from its raised position as shown in FIG. 1, it will move downwardly and strike the top part of strike plate 9 of a rapper bar or rod 10. Bar 10 is connected to a base plate 11, which in turn is attached to a structural member 12 of a usual electrostatic precipitator located below rapper system 1. The shock waves imparted by slug 7 to structural member 12 are then transmitted to the collecting plates and discharge electrodes which usually are suspended from structural member 12 to set up a vibration in the plates or electrodes for loosening the collected particulate material thereon.

Figure 2:
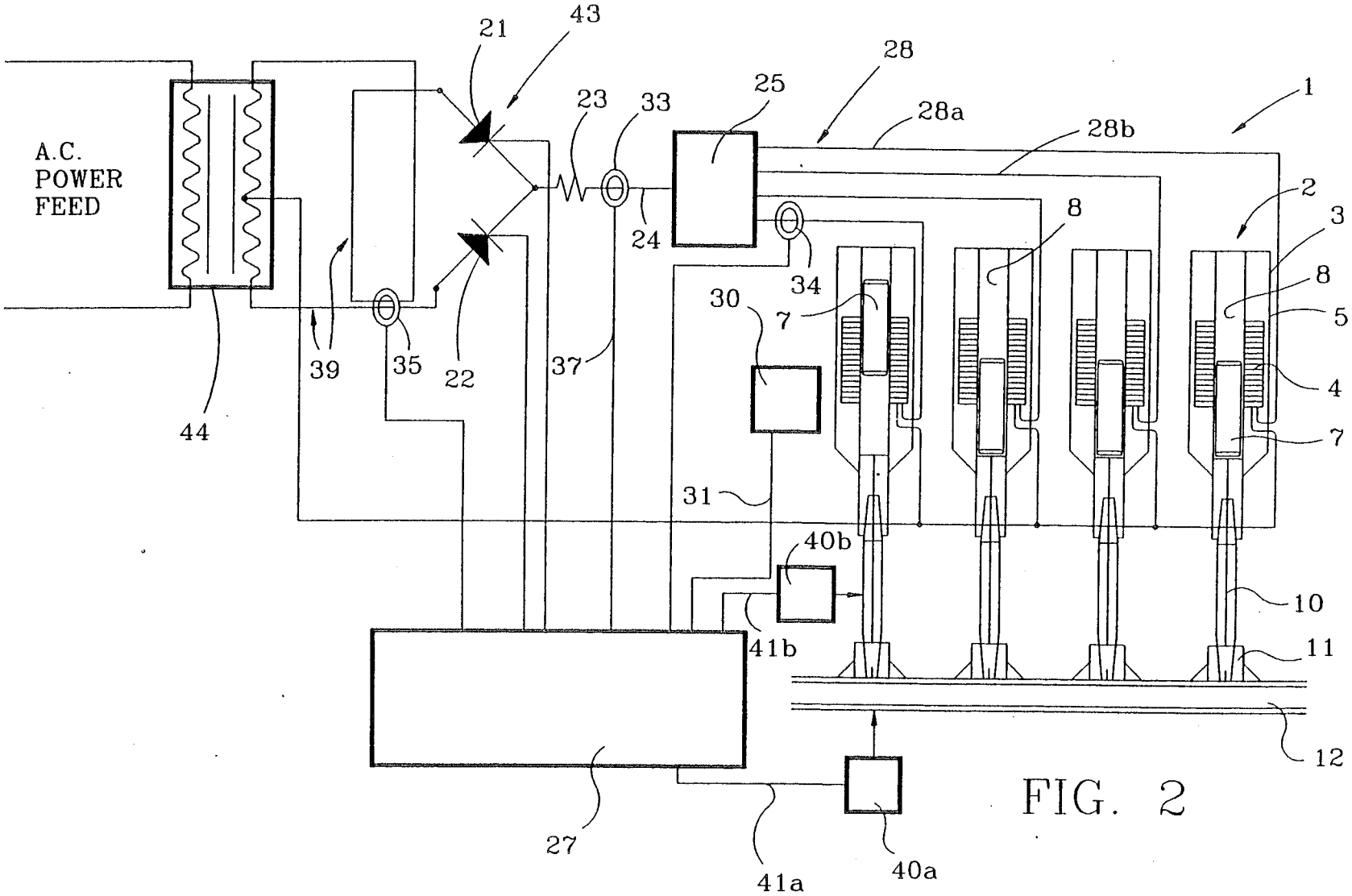
FIG. 2 is a schematic diagram of the improved rapper control system utilizing a center tapped full wave rectification circuit for regulating the rapper coil supply.
Figure 3:
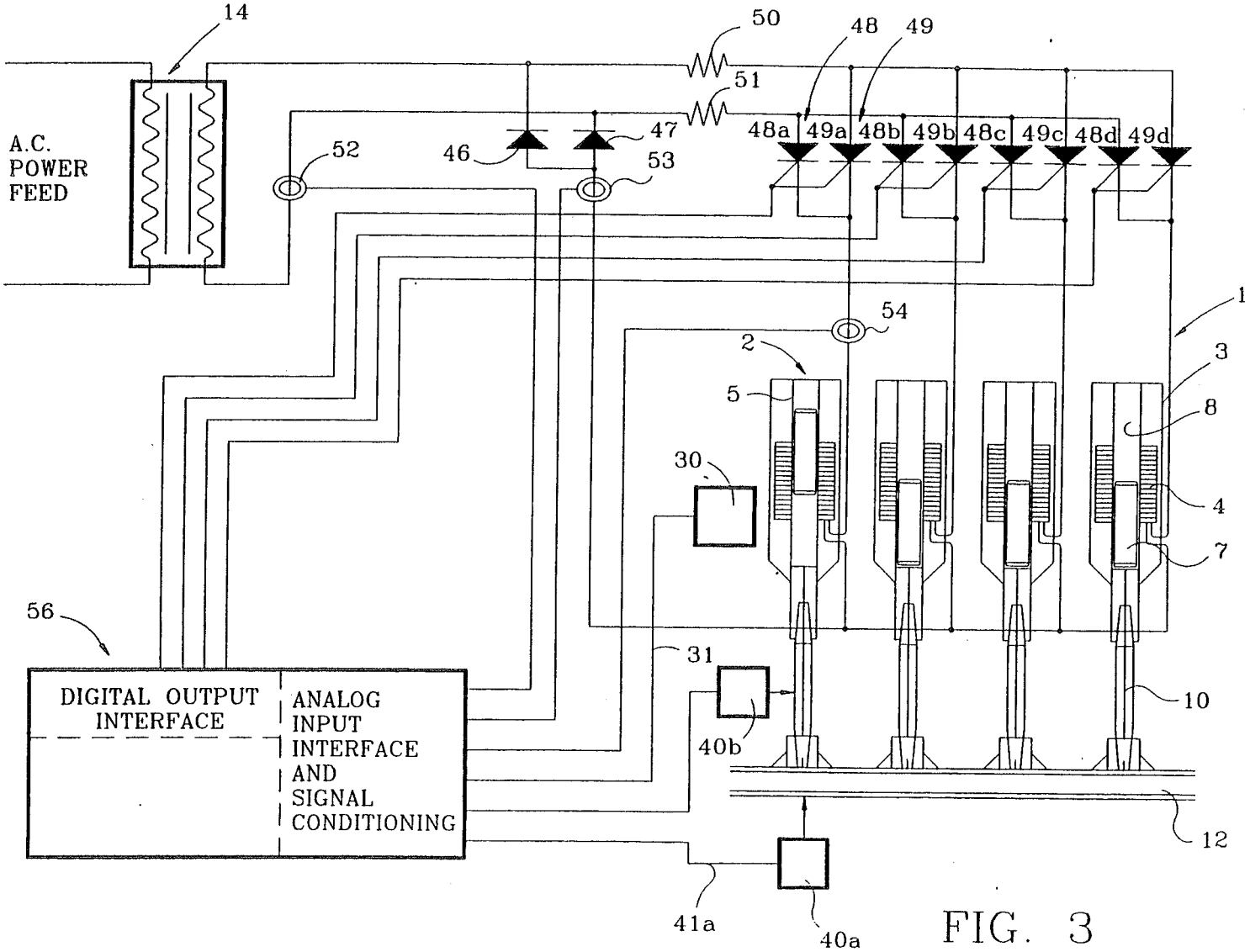
FIG. 3 is a schematic diagram of the improved rapper control system providing means to individually adjust the power supply for each rapper and utilizing a combined sequential controller and computational control unit.

An incoming AC power supply is connected to the input side of a usual transformer 14 which provides the proper voltage at the output terminals 15 and 16 thereof, for application to a full wave bridge rectifier circuit 18 consisting of rectifiers 19 and 20 and thyristors 21 and 22. The output of rectifier circuit 18 is applied to a current limiting resistor 23 which is sized to limit surge current through all parts of the control system to safe levels in the event of a short circuit. Resistor 23 is a protection device only and is not an essential part of the improved rapper control system. Resistor 23 is located in line 24 which is connected to a sequential controller 25. Controller 25 may be a separate component as shown in FIGS. 1 and 2, but more typically would be an integral part of a combination sequential controller and computational control unit 56 as shown in FIG. 3.

An example of such a combination sequential controller and computational control unit may be of the type manufactured by Neundorfer, Inc. of Willoughby, Ohio, the assignee of the present invention, identified under its trademark MicroRap. In the alternative, the same control features of sequential controller 25 and computational control unit 27 may be implemented on a usual micro computer system such as manufactured by IBM or like manufacturer.

For the particular four rapper arrangement of rapper system 1 shown in the drawings, separate output lines **28*a*, 28*b*, 28*c* and 28*d*, collectively referred to at 28, are connected to the appropriate coil 4 of each respective rapper 2. Most rapper control systems will utilize a plurality of rappers as shown in the drawings, and controller 25 will sequentially activate the individual rappers in a desired sequence and with the desired timing for energizing and deenergizing coils 4 for raising and then releasing slugs 7 from their raised positions for striking the associated rapper bars 10 or for actuating the magnetic impact spring return type of rapper. Slug 7 is shown in the raised position in the left-hand coil 4** in FIGS. 1–3.

In accordance with the present invention, a temperature sensor 30 is located in the vicinity of rapper coils 4. Only one temperature sensor 30 is shown in the drawings. However, it is understood that each coil 4 may have its own temperature sensor which communicates with control unit 27 through its own signal line 31. Usually, one temperature sensor 30 may suffice to provide temperature indications for more than one rapper since in most precipitators the ambient temperature will not vary appreciably among the individual rappers. A typical temperature sensor is of the type manufactured by National Semiconductor under its Model No. LM34.

In further accordance with the invention, one or more current sensors or current meters 33, 34 and 35, may be utilized to measure the current flowing through various parts of the control system. Sensor 33 is located in line 24 to provide information through line 37 to control unit 27, of the amount of current flowing into sequential controller 25. Current sensor 34 is mounted in line **28*d* and measures the current flowing to a particular coil 4 of one of the rappers. A current sensor 34 preferably will be located in each of the other power supply lines 28*a*, 28*b* and 28*c*, although only one sensor 34 is shown in the drawings. Current sensor 35 is located so as to sense the flow of alternating current from transformer 14 to rectifier circuit 18 making possible the use of usual AC current transformers. Sensors 33 and 34** are required to sense the flow of direct current and, therefore, require the use of a more specialized DC current sensor, such as the type manufactured by LEM USA and identified as Model Number LA50-P.

In furtherance with the invention, an energy sensor **40*a* is attached to structural member 12 of the precipitator so as to provide a signal through line 41*a* to control unit 27, indicative of the energy imparted to member 12 by rapper plungers 7. An alternate location for the energy sensor at 40*b* removes the sensor out of the harsh environment of the precipitator by attaching it to the rapper energy transmission assembly or bar 10, where it can still be used to provide feedback indicative of relative changes in delivered rapping energy through line 41*b*. A typical example of sensors 40*a* and 40*b*** would be an accelerometer of the type manufactured by IC Sensors and identified as its Model Nos. 3021 and 3026.

Referring to FIG. 1, the operation of the improved rapper control system is as follows. Power is supplied through transformer 14 to rectifier circuit 18, the output of which is connected to sequential controller 25 through line 24. Controller 25 in turn controls the sequence of energization and deenergization of the individual coils 4 of the rappers which are connected through their respective rapper bars 10 to precipitator member 12. The ambient temperature about coils 4 is sensed by temperature sensor 30 and the information is supplied to control unit 27 through line 31. Unit 27 may also receive feedback signals from one or more of the indicated current sensors as to the amount of current flow in lines 24 and 28 through lines 37 and 41, respectively, and the amount of current supplied to the rectifier circuit and hence to the coils through line 39 on the AC input side of rectifier circuit 18.

Computational control unit 27 preferably will be programmed by usual software or a specific control program, to regulate the length of time that the direct current is applied to the rapper coils through lines 28, or in the alternative will regulate the magnitude of the voltage delivered to the rapper coils and hence the resultant current flowing in the rapper coils by regulating the conduction angle or period of the rectifier/-switching devices 21 and 22 during each half cycle of the applied power.

Information from temperature sensor 30 is used by control unit 27 to alter the duration and/or magnitude of the power supplied to the rapper coils to compensate for known effects of temperature on rapper energy delivered, based upon a preprogrammed computer program contained in unit 27. If desired, information from current sensors 34 which measure the current flowing through the rapper coil, can be used by unit 27 to regulate the rapper coil power supply voltage magnitude in such a manner to provide constant current flow through the rapper coil independent of changes in rapper coil resistance due to changes in ambient temperature, so as to provide constant rapper energy output over the normal operating temperature range of the rapper. Information also may be supplied to control unit 27 from energy sensor **40*a* or 40*b* which measures the kinetic energy output of the individual rappers, to enable control unit 27** to develop and store the effects of changes in ambient temperature on rapper output, which can then be used with an appropriate algorithm to regulate the rapper power supply in such a manner as to provide relatively constant rapper energy output with changing ambient operating temperatures.

The particular control system shown in FIG. 2 is very similar to that of FIG. 1, with the exception that rectifier circuit 18 of FIG. 1 has been replaced with a modified rectifier circuit 43. Circuit 43 utilizes a center tapped full wave rectification circuit for the rapper control power supply instead of full wave bridge rectifier circuit 18 of FIG. 1. With this arrangement, a center tapped transformer 44 is utilized together with thyristors 21 and 22. Current sensor 35 is located as shown in FIG. 2 with the opposed ends of the secondary winding of transformer 44 passing through the sensor 35 in opposite directions to create an alternating magnetic flux in sensor 35 as the AC power feed changes polarity each half cycle of the power line. The same opposed wiring could be used to locate sensor 35 so as to sense alternating current on the cathode side of thyristors 21 and 22, allowing use of a common AC current transformer. The remainder of the various sensors and uses thereof in FIG. 2 is the same as that described above for FIG. 1, and therefore is not described in further detail.

FIG. 3 is a schematic drawing of the improved control system of the invention which provides an individually adjustable power supply for each rapper and combines the sequential controller and computational control unit into one unit shown at 56. The control system shown in FIG. 3 utilizes a pair of rectifiers 46 and 47 combined with a pair of gate controlled thyristors referred to generally as 48 and 49 and shown individually at **48*a*-49*a*, 48*b*-49*b*, 48*c*-49*c* and 48*d*-49*d* for each rapper, to provide individually adjustable power for each rapper 2 and solid state selection of the desired rapper or rappers to be activated at any moment in time. Resistors 50 and 51 are current limiting resistors sized to limit surge current through all parts of the control system to safe levels in the event of a short circuit in the connected rapper or wiring in a similar manner as resistors 23 shown in FIGS. 1 and 2**.

Current sensors 52, 53 and 54 preferably are utilized for measuring current flow into the rapper coil. Sensor 52 is a conventional AC current transformer located in the AC side of the rapper coil transformer 14. Sensor 53 is a DC current transformer or a solid state current sensor such as Model LA50-P manufactured by LEM USA of Germantown, Wis. or current measuring resistive shunt in the DC side of the rapper coil supply. Current sensor 54 is a DC current transformer, solid state current sensor, or current measuring shunt, located in the individual rapper circuits. These current sensors provide a signal to a computational control unit 56 indicating the current flowing in the energized rapper coil.

Box 56 represents a combined sequential controller and computational control unit consisting of previously identified items 27 and 25 as shown in FIGS. 1 and 2 and described above. As previously stated, unit 56 is best implemented by using a general purpose microcomputer such as an IBM PC or equivalent, with appropriate interface modules, or by using a specialized rapper controller such as the previously identified unit manufactured by Neundorfer, Inc., under its trademark MicroRap.

The particular computation and control program used by computational control unit 27 or combined sequential controller and computational control unit 56, can vary and is adaptable by one skilled in the art to the particular parameters to be used for a particular electrostatic precipitator and the particular rappers thereof. One of the main features of the invention is that a control unit uses one or more of the three types of sensors discussed above, namely, temperature sensor 40, energy sensors **40*a* and 40*b***, and the various current sensors, to provide information to the control unit which in turn adjusts the duration and/or the magnitude (voltage) of the rapper coil power supply to maintain more or less constant rapping energy over the wide range of operating temperatures.

In the embodiment depicted in FIGS. 1 and 2, control is by varying the number of half cycles of the AC power line during which thyristors 21 and 22 conduct (on time control) and/or by varying the portion of each half cycle during those half cycles of conduction in which the thyristors are caused to conduct, commonly known as phase firing.

In the embodiment depicted in FIG. 3, control is by varying the number of half cycles of the AC power line during which thyristors 48 and 49 conduct (on time control) and/or by varying the portion of each half cycle during those half cycles of conduction in which the thyristors are caused to conduct (phase firing).

The invention can be implemented using various combinations of the temperature sensors, current sensors and energy sensors, and need not have the exact configurations and uses thereof as shown in FIGS. 1-3. The power supplied to the rappers regulates the lift height of rapper slug 7 in a "gravity fall" type of rapper or regulates the magnetic force which is applied to a magnetic impact/spring return type of rapper wherein a positive force is applied to the slug 7 for striking strike plate 9, dependent upon the strength of the magnetic force created by the current applied to coil 4, instead of relying upon the fall height of the slug.

Accordingly, the improved rapper control system provides an effective, safe, and efficient system which achieves all the enumerated objectives, provides for eliminating difficulties encountered with prior systems, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved rapper control system is constructed and used, the characteristics of the system, and the advantageous, new and useful results obtained; the new and useful structures, devices, elements, arrangements, parts and combinations, are set forth in the appended claims.

I claim:

1. A rapper control system for an electrostatic precipitator including:

a) power supply means for supplying electrical power to a rapper device mounted on an electrostatic precipitator;

b) control means for regulating the electrical power supplied to the rapper device by the power supply means;

c) temperature sensing means located generally adjacent the rapper device for measuring ambient temperature adjacent said rapper device; and d) first feedback means interconnecting the temperature sensing means and the control means for adjusting the output of the power supply means in direct relationship to changes in ambient temperature measured by the temperature sensing means.

2. The rapper control system defined in claim 1 including current sensing means for measuring the current flowing to the rapper device from the power supply means.

3. The rapper control system defined in claim 2 including second feedback means for transmitting a signal representation of the current flow measured by the current sensing means to the control means.

4. The rapper control system defined in claim 1 including energy sensing means for measuring the energy output of the rapper, and third feedback means for transmitted a signal representation of said measured energy output to the control means.

5. The rapper control system defined in claim 4 in which the energy sensing means is an acceleration sensor attached to the rapper.

6. The rapper control system defined in claim 4 in which the energy sensing means is an acceleration sensor attached to the precipitator.

7. The rapper control system defined in claim 1 in which the power supply means include a transformer and a full wave bridge rectifier circuit connected to the output of said transformer.

8. The rapper control system defined in claim 1 in which the power supply means includes a center tapped transformer and a full wave rectifier circuit connected to the output of said transformer.

9. The rapper control system defined in claim 1 in which the control means includes thyristors; and in which the control means regulates the current and voltage supplied to the rapper device by regulating the phase firing of the thyristors.

10. The rapper control system defined in claim 1 in which the control means regulates the duration which the electrical power is supplied to the rapper device.

11. The rapper control system defined in claim 1 in which the rapper device is an impact rapper having an energy transmitting slug movably mounted within a magnetic coil energized by the power supply means.

* * * * *